US005443539A

United States Patent [19]

Westelaken

[11] Patent Number: 5,443,539

[45] Date of Patent: Aug. 22, 1995

[54] PARTICULATE DRYER

[76] Inventor: Christianus M. T. Westelaken, P.O. Box 1349, Grand Bend, Ontario, Canada, N0M-1T0

[21] Appl. No.: 302,169

[22] Filed: Sep. 8, 1994

[51] Int. Cl.[6] ..... F26B 3/08

[52] U.S. Cl. ..... 34/370; 34/65; 34/168; 34/170; 34/364; 34/579; 34/589

[58] Field of Search ..... 34/166, 168, 174, 175, 34/176, 177, 170, 171, 178, 391, 394, 428, 432, 436, 62, 64

[56] References Cited

U.S. PATENT DOCUMENTS

| | | | |
|---|---|---|---|
| 2,706,343 | 4/1955 | Oholm | 34/13 |
| 4,086,708 | 5/1978 | Westelaken | 34/65 |
| 4,125,945 | 11/1978 | Westelaken | 34/65 |
| 4,398,356 | 8/1983 | Westelaken | 34/65 |
| 4,423,557 | 1/1984 | Westelaken | 34/56 |
| 4,424,634 | 1/1984 | Westelaken | 34/167 |

*Primary Examiner*—Denise L. Gromada
*Assistant Examiner*—Susanne C. Tinker
*Attorney, Agent, or Firm*—Luedeka, Neely & Graham

[57] ABSTRACT

This invention relates to a dryer for uniform drying of moisture laden particulate material. The dryer comprises a substantially vertical tower having a top, a bottom, side walls, a moist material inlet, a moist material distribution section below the inlet, a drying section below the distribution section and a cooling section below the drying section. The drying section contains a heated air inlet and air exhaust assemblies, wherein the air exhaust assemblies are formed from a plurality of discharge chambers extending horizontally across the tower between the side walls for flow of particulate material therebetween. Each discharge chamber contains at least one horizontally disposed exhaust tubular member having an aperture in the lower portion of the tubular member for exhausting air. Each discharge chamber also contains at least one aperture in the upper portion thereof for receiving air. The aperture in the discharge unit is covered by a foraminous member sized to substantially limit the amount of particulate material entering the aperture of the discharge chamber.

37 Claims, 7 Drawing Sheets

PARTICULATE DRYER

FIELD OF THE INVENTION

This invention relates to dryers and in particular to dryers suitable for uniformly drying particulate material.

BACKGROUND

The drying of large quantities of particulate or powdery materials to a desired moisture content provides difficulties especially for heat sensitive materials such as grain. Without uniform drying, degradation of heat sensitive materials may occur in the hot areas of the dryer, while other areas of the dryer may not sufficiently dry the particulate material without prolonged drying times. There is a balance therefore between the drying time and the drying temperature that is used to dry the particulate material that must be met, particularly if the particulate material is prone to degradation from overheating. For example, if grain is heated too quickly and then quickly cooled during the drying operation, the sudden temperature changes may tend to cause stress cracking and shattering of the grain. Such cracking or shattering of the grain greatly lowers the value of the grain such that it may not be acceptable to many grain elevators and processors.

In some instances, uniformity of the moisture content of the dried particulate material is ultimately important. Excessive moisture in a portion of the particulate material after drying may present problems with handling, particularly if the material is prone to agglomeration in the presence of moisture. Furthermore, the presence of undesirable moisture may increase the corrosion rate of storage vessels containing particulate materials such as halogenated catalysts and the like. In the foregoing examples, uniform drying of particulate material to a desired moisture level is an important consideration.

Many systems have been developed over the years which are intended to heat and uniformly dry particulate material such as grain while at the same time avoiding problems associated with drying heat sensitive materials. One such system is the cross-flow column type particulate dryer in which heated air is transversely forced through a moving bed of particulate material so as to dry the material. Because the heated air is hotter on one side of the drying column than on the other, difficulties are encountered in trying to provide uniform drying across the bed of particulate material in the dryer. Particulate material closest to the hot air inlet will generally be dried faster and to a greater degree than material on the opposite side of the dryer from the hot air inlet.

Counter flow drying systems may also be used to dry particulate materials. In this case, heated air is forced through the particulate material in a direction opposite to the direction of flow of the material through the dryer. As with the cross-flow dryers, the material nearest the hot air inlet of the counter flow dryer is hotter and is dried more than the material near the air exhaust outlet. In order to obtain a desired moisture content for the particulate material as a whole, a portion of the material may have to be over dried or otherwise overheated. While counter flow dryers may be more efficient, they are not particularly well suited to the drying of heat sensitive materials.

A particularly useful dryer for heat sensitive materials is the concurrent-countercurrent flow dryer in which heated air travels through the particulate material in the same direction as the moving bed of particulate material and a countercurrent flow of cooling air travels in a direction opposite to the direction of flow of the particulate material. In this system, air exhaust means are provided intermediate the hot air inlet and cooling air inlet of the dryer. With such a system, the hottest air is available at a point in the dryer whereby it is of the greatest value, i.e. wherein the particulate material is the wettest and coolest. As the particulate material and hot air travel together, the air heats and dries the particulate material while the moisture removed from the particulate material gradually cools the air. The counter flow of cooling air serves to further cool and temper the particulate material before it reaches the outlet of the dryer.

One of the earliest concurrent-countercurrent dryers is described in U.S. Pat. No. 2,706,343 to Oholm. However, the Oholm system has the disadvantage of presenting a V-shaped particulate surface area exposed to the entering hot air. This V-shaped surface area of the particulate bed typically results in the particulate material falling free from a feed spout into a pile having sloped conical sides. Thus, the length of time that individual particles are exposed directly to the hot air will vary according to their position on the pile, with those particles near the peak of the pile being exposed for a shorter period than those on the side slopes of the pile. With such a system, in order to arrive at some acceptable average moisture level for the bulk of the particulate material flowing through the dryer, it may be necessary to over dry at least a portion of the particulate material.

Many of the above problems associated with particulate dryers have been solved by the dryer disclosed in U.S. Pat. No. 4,086,708 to Westelaken. Westelaken describes an improved hot air contacting arrangement for a dryer which includes a wet material bin having a horizontal floor assembly with a plurality of uniformly spaced openings with a tube member extending downwardly beneath each such opening. These tubes serve to deliver wet particulate material in response to gravity from the wet material bin into a drying zone. The floor assembly permits the wet particulate material to be cyclically delivered into the drying zone with a pulsating action. This pulsating action causes a lateral flow of particulate materials resulting in layers of wet particulate material being deposited in the drying zone for contact with hot air. A hot air inlet duct is provided adjacent the tube members to deliver hot air into the spaces between the tube members and downwardly through the bed of particulate material in the drying zone. Below the drying zone is a cooling zone. The cooling zone has metering outlets for the particulate material as well as cooling air inlet ducts. Exhaust air ducts are provided intermediate the drying and cooling zones.

In the Westelaken system, the efficiency of the dryer is based, at least in part, on the use of drying temperatures in excess of 500° F. (260° C.) near the hot air inlet. Accordingly, careful control over the flow of particulate material and hot air are essential to obtain a uniform rate of particulate drying across the drying zone. Any blockages in the flow of the particulate material or channeling of the air in the bed of particulate material must be avoided, particularly for heat sensitive materials.

In concurrent-countercurrent flow dryers, the burner size for providing heat and the tower size are all generally determined by volume and moisture content of the particulate material to be dried. Accordingly, a system designed to dry very wet material may require very high heat inputs and very high air flow volumes. Such concurrent-countercurrent dryers typically operate at their greatest efficiency when the air flow within the dryer is maintained at the minimum necessary to remove the desired amount of moisture from the particulate material, while still maintaining uniform air distribution. However, the moisture level of some particulate material, such as grain, is dependent on weather conditions in the region where the grain is grown and stored. In a region with traditionally high moisture levels, there may be a year of low moisture and hence very low particulate material moisture levels. Thus, there may be a need to adjust the air distribution within the dryer to account for variations in the moisture content of the particulate materials. There may also be a need to adjust the air distribution if the same dryer is used for a variety of particulate material, each material having its own drying characteristics.

It is an object of the invention to provide a dryer suitable for the uniform drying of large quantities of particulate materials.

It is another object of the invention to provide a concurrent-countercurrent dryer having a modified air discharge duct for essentially even distribution of drying and cooling air.

Yet another object of the invention is to provide an adjustable air exhaust mechanism for a particulate dryer.

Still another object of the invention is to provide a concurrent-countercurrent dryer for the uniform drying of particulate material wherein the drying air flow volume and distribution can be readily adjusted for variations in the moisture content of the particulate material to be dried.

Other objects and benefits of the invention will be evident from the following discussion and appended claims.

SUMMARY OF THE INVENTION

With regard to the foregoing objects, the present invention provides a concurrent-countercurrent flow dryer for the uniform drying of moisture laden solid material. The dryer comprises a tower with side walls, a top, a bottom, an upper section having a receiving bin for receiving moisture laden solid material to be dried; a middle section having at least one drying zone; and a lower section having a cooling zone below the drying zone for cooling the material as it enters by gravity from the drying zone. The receiving bin has a drying floor assembly extending horizontally across between the side walls of the tower, the floor assembly having a plurality of essentially uniformly spaced openings extending over substantially the entire floor assembly. The openings provide entry into moisture laden material delivery tube members fixed beneath each opening which serve to deliver moisture laden material in response to gravity from the receiving bin through the tube members into the drying zone. The drying zone has a heated air inlet adjacent the tube members adapted to deliver heated air into the spaces between the tube members and downwardly through a bed of moisture laden solid material in the drying zone. The cooling zone contains a cooling air inlet and a dry material outlet for collection and discharge of dry solid material. A plurality of air exhaust assemblies for flow of solid material therebetween. The exhaust assemblies are positioned intermediate the drying and cooling zones and extend horizontally across the tower between the side walls for receiving and exhausting air from the drying zone through the bed of material to be dried in a concurrent direction to the flow of material. The air exhaust assemblies also receive and exhaust cooling air from the cooling zone through the bed of material in a countercurrent direction to material flow. Each air exhaust assembly contains a discharge chamber having an upper portion and a lower portion and at least one horizontally disposed exhaust tubular member having an aperture, preferably in the lower portion thereof, for exhausting air. Each discharge chamber also contains at least one aperture in the upper portion thereof for receiving air. The aperture in each discharge chamber is covered by a foraminous member sized to substantially limit the amount of particulate material entering the aperture of the discharge chamber.

An important feature of the present invention is the unique design of the air discharge chamber for collecting and discharging heating and cooling air from the drying zone. Each discharge chamber contains one or more exhaust tubular members which preferably contain adjustable apertures for adjusting the air flow and air distribution in the drying zone. By providing tubular members, preferably with adjustable apertures, it is now possible to match the discharge flow volume to the desired drying air input volume such that the air flow distribution in the drying zone will not be disturbed when the inlet air flow volume is changed. Hence the versatility of the dryer is greatly improved, thus permitting the drying of particulate materials with widely varying moisture levels simply by adjusting the air flow volume in the dryer.

Adjustable apertures in the exhaust tubular members may be provided by use of concentric tubular members rotatably disposed relative to one another, each tubular member containing one or more apertures longitudinally disposed along the length of the tubular members. The apertures in the inner and outer tubular members are aligned relative to one another such that rotation of the inner or outer tubular member relative to the other tubular member varies the effective opening through the apertures of the tubular members. The exhaust apertures may also be adjusted by removing some of the tubular members and plugging the portion of the exhaust outlet which previously contained the tubular member or by substituting tubular members having different diameters or numbers of apertures.

Another feature of the air exhaust assembly is the particular configuration which not only limits the amount of particulate entrained in the exhaust air exiting the dryer, but also provides an essentially self-cleaning foraminous surface for exhausting air from the drying zone.

In another embodiment, the invention provides a dryer for uniform drying of moisture laden particulate material. The dryer comprises a substantially vertical tower having a top; a bottom; side walls; a moist material inlet; a moist material distribution section below the inlet; a drying zone below the distribution section containing a heated air inlet; a cooling zone below the drying zone containing a cooling air inlet; and a plurality of air exhaust assemblies. Each air exhaust assembly contains a discharge chamber having an upper and a lower portion extending horizontally across the tower between the side walls for flow of particulate material therebetween. The discharge chamber contains at least one horizontally disposed exhaust tubular member having an aperture, preferably in the lower portion thereof, for exhausting air. Each discharge chamber also contains at least one aperture in the upper portion thereof for receiving air. The aperture in the discharge chamber is covered by a foraminous member sized to substantially limit the amount of particulate material entering the aperture of the discharge chamber.

In yet another embodiment, the invention provides a method for uniformly drying particulate material utilizing the concurrent-countercurrent dryer of this invention.

In a particularly preferred embodiment of the invention, the exhaust tubular members horizontally disposed within the air exhaust chambers of a concurrent=countercurrent dryer contain adjustable apertures for varying the flow of drying air in the dryer.

Other aspects and advantages of the invention will be evident from the description of the drawings.

DETAILED DESCRIPTION OF THE INVENTION

Figure 1:
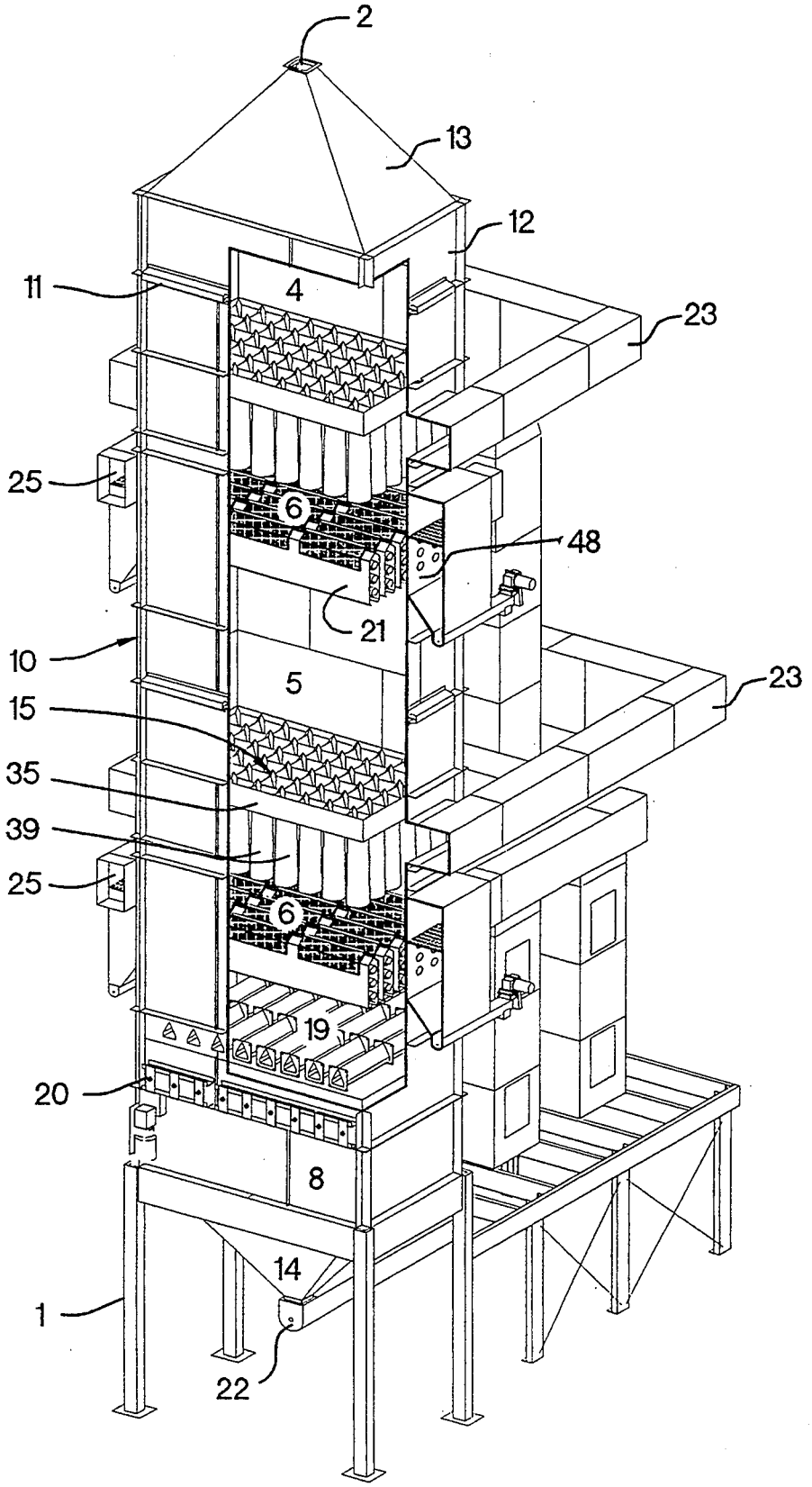
FIG. 1 is a perspective view, not to scale, of the overall configuration of a concurrent-countercurrent dryer of this invention.
Figure 2:
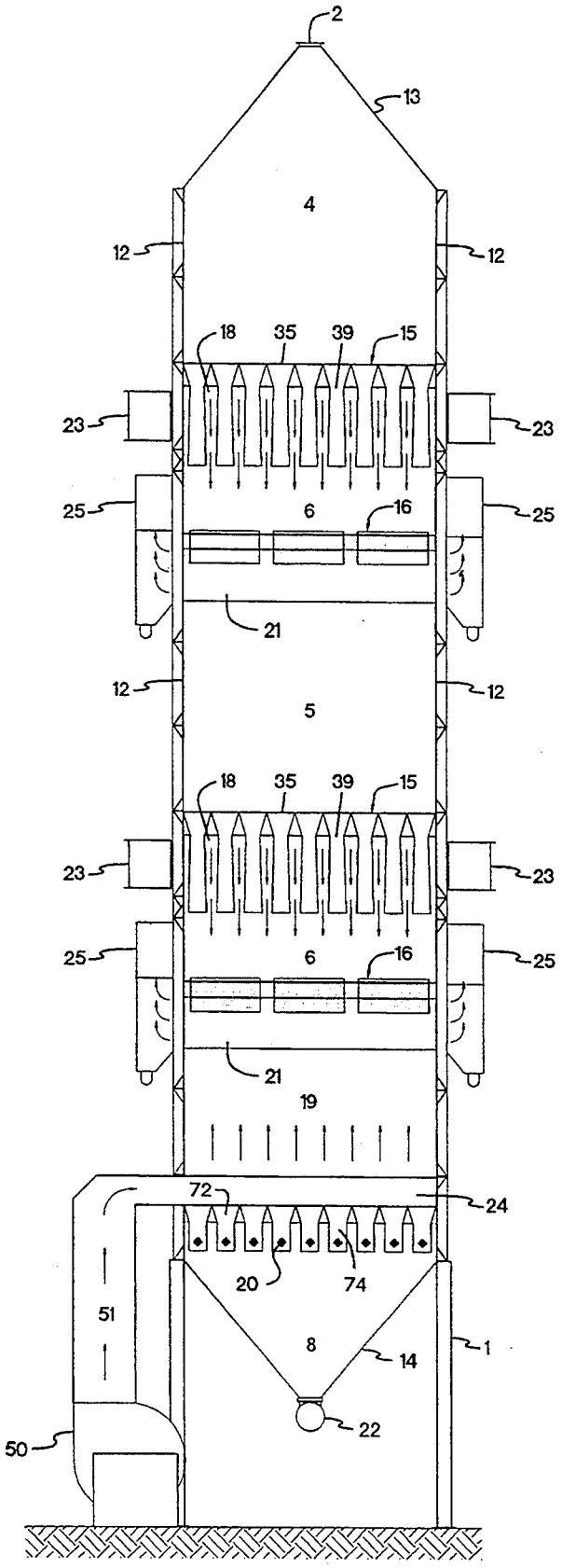
FIG. 2 is a cross-sectional cut-away view, not to scale, of the overall configuration of a concurrent-countercurrent dryer of this invention.

FIGS. 1 and 2 illustrate overall configurations for concurrent-countercurrent flow dryers of this invention. The dryer 10 is typically constructed in a series of sections including frame members 11, Sheet metal panels forming the side walls 12 of the dryer, a top 13 and a bottom 14 all supported by support legs 1.

Moisture laden particulate material is introduced through inlet 2 into the upper section of the dryer containing receiving bin 4. Receiving bin 4 contains a floor assembly 15 extending horizontally across between the side walls 12 of the dryer. The floor assembly 15 contains a bottom plate member 35 having a plurality of essentially uniformly spaced openings extending over substantially the entire floor assembly area. The openings provide entry into particulate delivery tube members 39 fixed beneath each of said opening in the bottom plate member 35. The delivery tube members 39 are of a size and spacing from each other such that the particulate material to be dried is delivered through the tube members 39 into the drying zone 6 with a pulsating action such that the particulate material flowing into the drying zone 6 forms a layer over the entire cross-sectional area of the drying zone 6 during each pulsation. A particularly preferred floor assembly 15 and the operation thereof is described in U.S. Pat. No. 4,086,708 incorporated herein by reference as if fully set forth.

The drying zone 6 is located in the middle section of the dryer below the receiving bin 4 and floor assembly 15. Heated air which enters through duct 23 adjacent the particulate delivery tube members 39 attached to the floor assembly 15, dries the particulate material in the drying zone 6 and exits the drying zone 6 through a plurality of air exhaust assemblies 21 through tube sheet 48 adjacent .the outlet of exhaust assemblies 21.

A cooling zone 19 is located in the lower portion of the dryer below the drying zone 6. Dried particulate material in the cooling zone 19 is discharged through metering rolls 20 (FIG. 2) into hopper 8 below the cooling zone 19. Material from hopper 8 may be discharged by discharge conveyer 22 (FIG. 2) to storage silos.

Although multiple drying and cooling zones are illustrated, the dryer may contain only one drying and cooling zone.

Typically, a control room is provided adjacent the dryer for control and monitoring of dryer operation.

Illustrated in FIG. 2 is a preferred configuration of a dryer of this invention having a tempering zone 5 below the drying zone and a second drying zone 6 below the tempering zone 5. The tempering zone serves to redistribute the moisture in the material to be dried such that more even drying of the bulk of the material can be obtained. Also illustrated in this figure is a heated air flow 18 from heated air inlet duct 23 which enters around delivery tube members 39 into drying zones 6. Because of the modular configuration of each drying and tempering zone, a plurality of such zones can be inserted in the dryer between the receiving bin 4 and the cooling zone 19.

Particulate material from receiving bin 4 or tempering zone 5 is fed by gravity through delivery tube members 39 into drying zones 6 whereby it is partially dried as the drying air exhausts through exhaust assemblies 21 into exhaust duct 25.

Cooling air 51 provided by blower 50 enters cooling zone 19 through cooling air distribution unit 24 which distributes the cooling air laterally across the dryer. The cooling air 51 cools and further tempers the particulate material in the cooling zone 19 before the cooling air exits the dryer through exhaust assembly 21 and exhaust duct 25.

Also illustrated in FIG. 2, is a side view of the foraminous members 16 covering apertures in the exhaust assemblies 21. It is preferred that the foraminous members 16 be sectionally disposed along the length of the exhaust assemblies 21 in order to assist in their installation and removal from the dryer. However, longer sectional members or a continuous foraminous member 16 may also be used.

Figure 3:
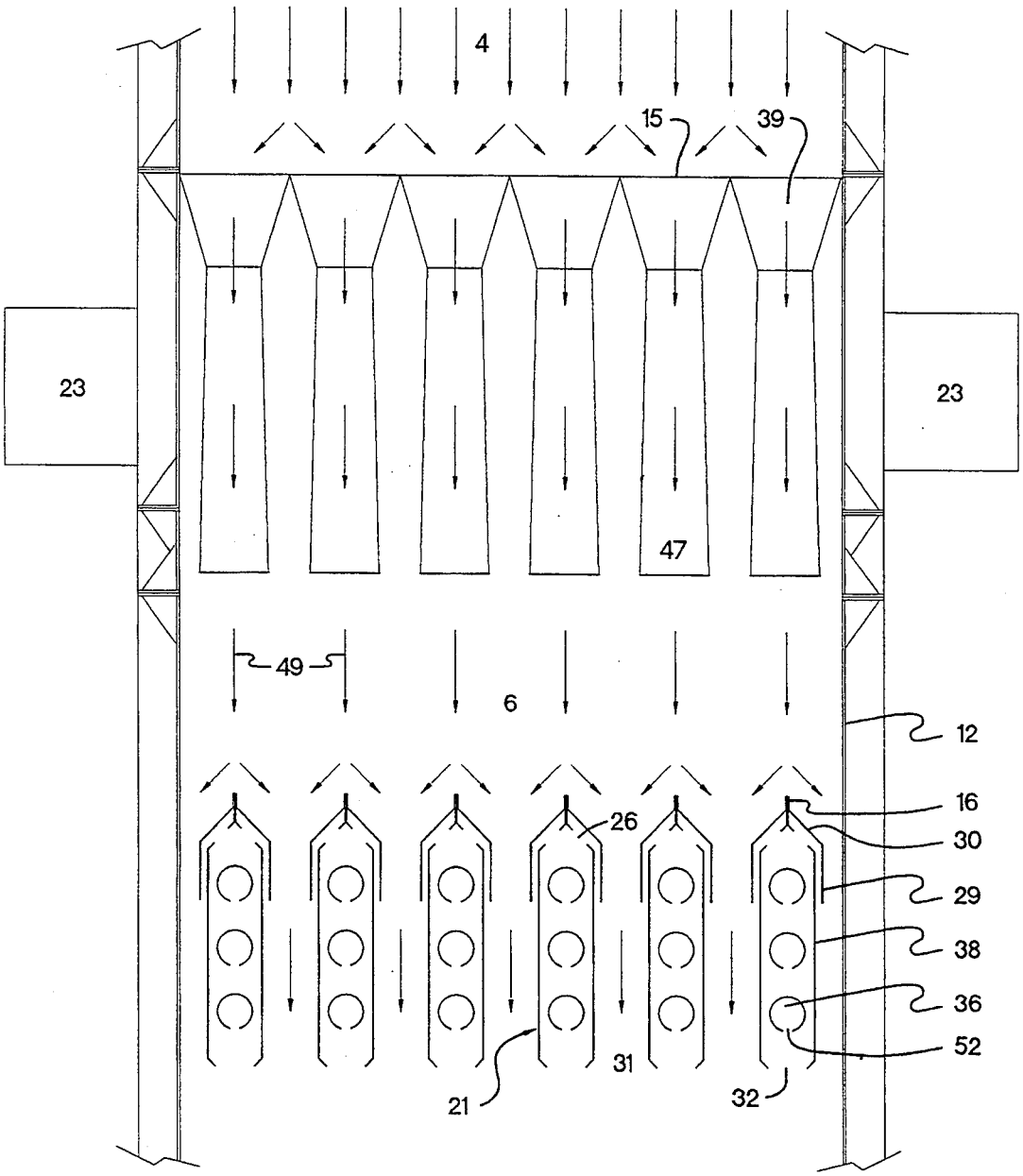
FIG. 3 is a cross-sectional view, not to scale, of the particulate inlet tubes and a typical drying zone of the concurrent-countercurrent dryer of this invention.
Figure 4:
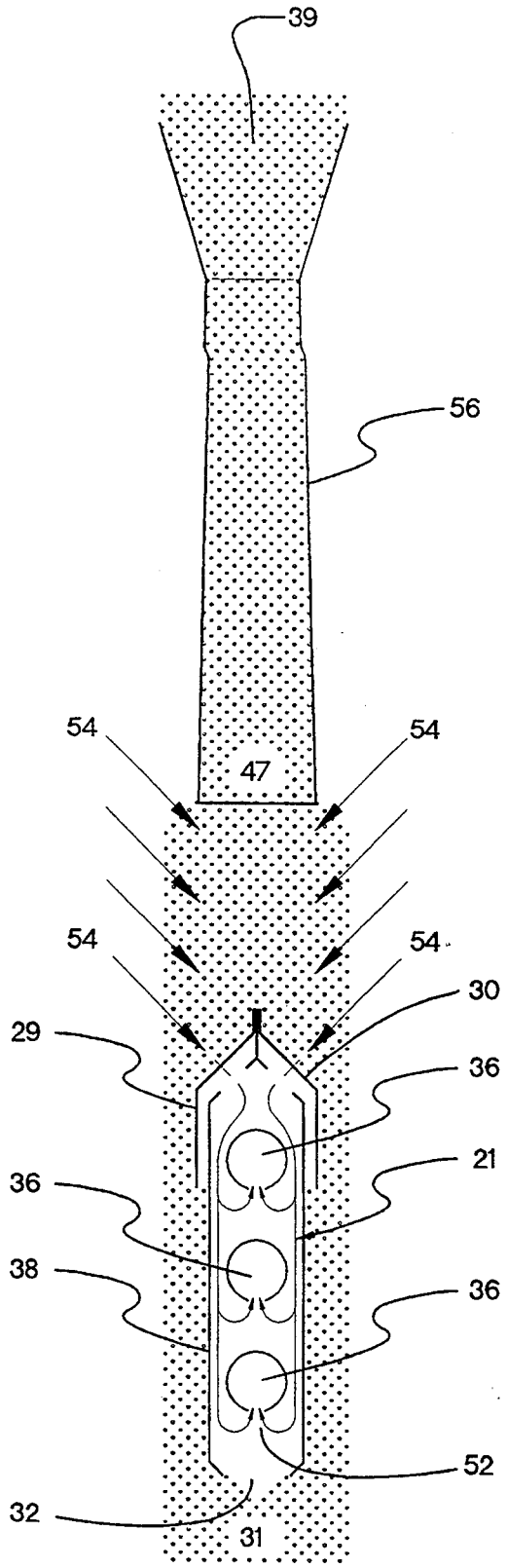
FIG. 4 is an illustration of the particulate flow and air flow in the drying zone of the concurrent-countercurrent dryer of this invention.

In FIGS. 3 and 4, a sectional view through the delivery tubes 39 in one drying zone 6 is illustrated. Also illustrated are details of the preferred exhaust assemblies 21 viewed longitudinally through the exhaust assemblies. In this illustration, particulate material 47 to be dried is fed from receiving bin 4 or tempering zone 5 through delivery tubes 39 into drying zone 6. The delivery tubes 39 preferably contain thermal insulation 56 (FIG. 4) of ceramic fiber paper such as FIBERFAX® refractory material Grade 970J (available commercially from Carborundum Corp.) Suitable insulating material is typically $\frac{1}{8}$ inch thick (3.2 mm) and has a continuous high temperature use of about 2300° F. (1260° C.) and a softening point of about 3260° F. (1790° C.). The thermal insulation 56 prevents excessive heat from the heated air entering the dryer from heated air inlet duct 23 from affecting heat sensitive particulate material in the delivery tubes 39.

Heated drying air enters the dryer through inlet ducts 23 adjacent the delivery tubes 39 and passes through the particulate material in the direction of flow of the particulate material indicated by arrows 49 as the particulate moves from the receiving bin 4 through the drying zone 6. The heated drying air passes through the exhaust assembly 21 in the direction indicated by arrows 54 (FIG. 4). Dry particulate material 31 flows adjacent the exhaust assemblies 21 into a tempering zone 5 and/or cooling zone 19 (FIG. 2). In order to achieve uniform drying of particulate material, it is important assure that the flow of material adjacent either side of the exhaust assembly is substantially the same. This can be accomplished, for example, by centering the delivery tube 39 above the exhaust assembly 21 as illustrated in FIG. 4. Other means for assuring even flow of material through the drying zone may also be used.

The preferred exhaust assemblies 21 contain substantially parallel side walls 38 forming a chamber with apertures 26 in the upper portion of the chamber for exhaust of drying air and preferably apertures 32 in the lower portion thereof for discharge of any particulate material which may be entrained in the air entering the chamber or which may pass through the foraminous member 16. A detailed description of the preferred exhaust assembly of this invention is contained in the description of FIG. 9 below.

The apertures of the exhaust assemblies 21 are covered by foraminous members 16 having vertical sections 29 and angular sections 30 for exhausting air and for reducing pluggage of the foraminous member by particulate material. The flow of particulate material adjacent the foraminous member 16 has the effect of sweeping particulate material from the angular and vertical sections 29 and 30 in a self-cleansing manner.

A key feature of the invention, illustrated in FIGS. 3 and 4, is the one or more exhaust tubular members 36 longitudinally disposed within the exhaust assemblies 21, each tubular member having apertures 52 preferably in the lower portion thereof. In a preferred embodiment, each exhaust assembly 21 contains at least three exhaust tubular members 36. The number of exhaust tubular members 36 and the size of the apertures 52 in each exhaust tubular member 36 are selected based on the volume of air needed to dry and cool the particulate material. Accordingly, the entire design of the exhaust assembly 21 having the foraminous member 16 covering apertures 26 allows for precise control of the air discharge volumes without worry about reduction in air volume flows due to plugging of the exhaust assemblies. By simply adding, subtracting or substituting exhaust tubular members having different diameters, aperture sizes or number of apertures a dryer originally designed for drying a particulate material having a set moisture content, can be readily reconfigured to handle a different particulate material with a different moisture content.

In the alternative, the apertures 26 in the exhaust assemblies 21 may be adjustable rather than the apertures in tubular members 36. This may be accomplished by providing moving plates having apertures adjacent the apertures 26. Other means known to those skilled in the art may be used to provide adjustable apertures in the upper portion of the exhaust assemblies.

Figure 6:
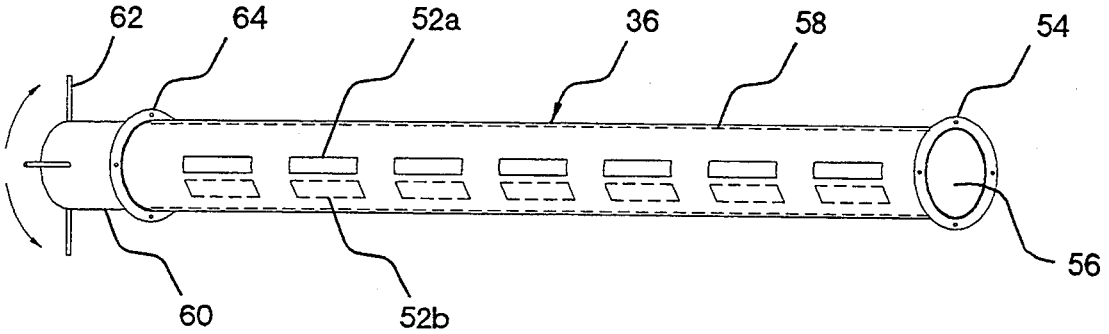
FIG. 6 is an illustration of an adjustable exhaust tubular member.
Figure 7:
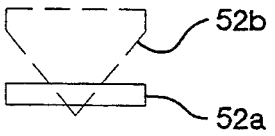
FIGS. 7 and 8 are illustration of various apertures suitable for the exhaust tubular members.
Figure 8:
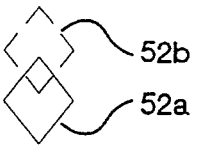

A particularly preferred exhaust tubular member 36 with adjustable apertures is illustrated in FIG. 6 with various aperture configurations illustrated in FIGS. 7 and 8. The adjustable tubular member 36 is comprised of an inner tubular member 60 having apertures **52*b* (illustrated in outline) disposed within an outer tubular member 58 having apertures 52a. The outer tubular member 58 preferably contains flanges 54 and 64 for fixedly attaching the outer tubular member between the side walls 12 (FIG. 1) of the dryer. As illustrated, rotation of the inner tubular member 60 using positioner 62 can be used to vary the cross-sectional opening through apertures 52*a* and 52*b*. Exhaust air entering apertures 52*a* and 52*b* then exits from the tubular member through opening 56 in both ends of the inner and outer tubular members 58 and 60. As illustrated in FIGS. 7 and 8, the apertures 52*a* and 52*b* in the inner and outer tubular members may have any desired configuration such as the rectangular and triangular-shaped apertures 52*a* and 52*b* of FIG. 7 or the diamond-shaped apertures 52*a* and 52*b* of FIG. 8**. Other configurations or combination of shapes may be used to provide adjustable apertures in the exhaust tubular members. While the apertures are illustrated as discreet openings in the tubular members, it will be recognized that any number, size, or even a continuous slot may be used as the aperture. It is preferred, however, that the apertures be equally spaced along the length of the inner and outer exhaust tubular members in order to provide even flow of exhaust air over the entire cross-section of the dryer between the side walls.

The inner exhaust tubular member 60 can be moved relative to the outer exhaust tubular member 58 either manually or by a power system which may be connected to the central control system for the dryer. In the alternative, the inner exhaust tubular member may be fixedly attached on one end by flange 54 to the side wall of the dryer and the outer exhaust tubular member 58 may be rotated relative to the inner tubular member by means of positioners 62 disposed on the opposite end of the exhaust tubular members from flange 54.

Figure 5:
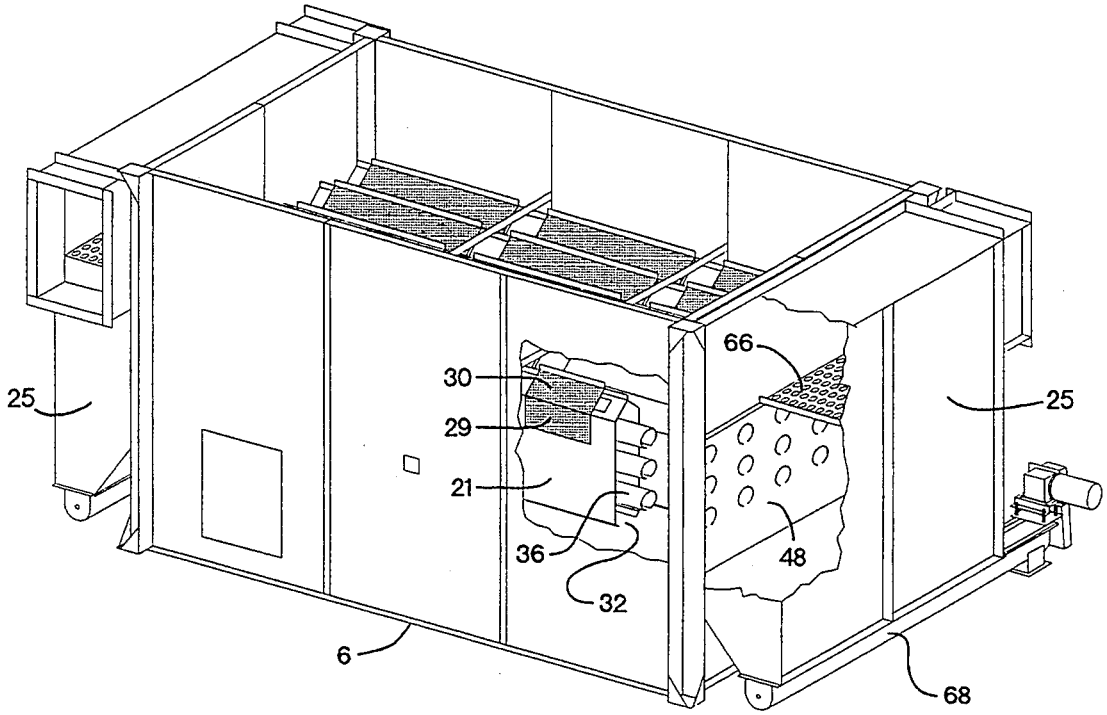
FIG. 5 is a detailed perspective cut-away view of a preferred drying zone of the concurrent-countercurrent dryer of this invention.

FIG. 5 illustrates a drying zone unit which may be preassembled for ready installation at the dryer construction site below the drying zones 6 of the dryer. The unit contains a plurality of air exhaust assemblies 21 having sectional foraminous members having angular and vertical sections 30 and 29. The exhaust assemblies 21 also contain one or more exhaust tubular members 36 which are fixedly attached at their ends to a tube sheet 48 for exhaust of air into the exhaust duct 25. Exhaust duct 25 preferably contains a flow equalizer 66 for equalizing the air velocity exiting the exhaust tubular members 36 thus providing substantially equal air flow from one side of the dryer to the other as the air enters the exhaust assemblies. If the exhaust air exiting the tubular members 36 contains any entrained particulate material, this material may be removed by the equalized and thus reduced air velocity in duct 25. Any particulate material thus removed is collected in the lower portion of the exhaust duct 25 for removal by particulate conveyer 68.

Figure 9:
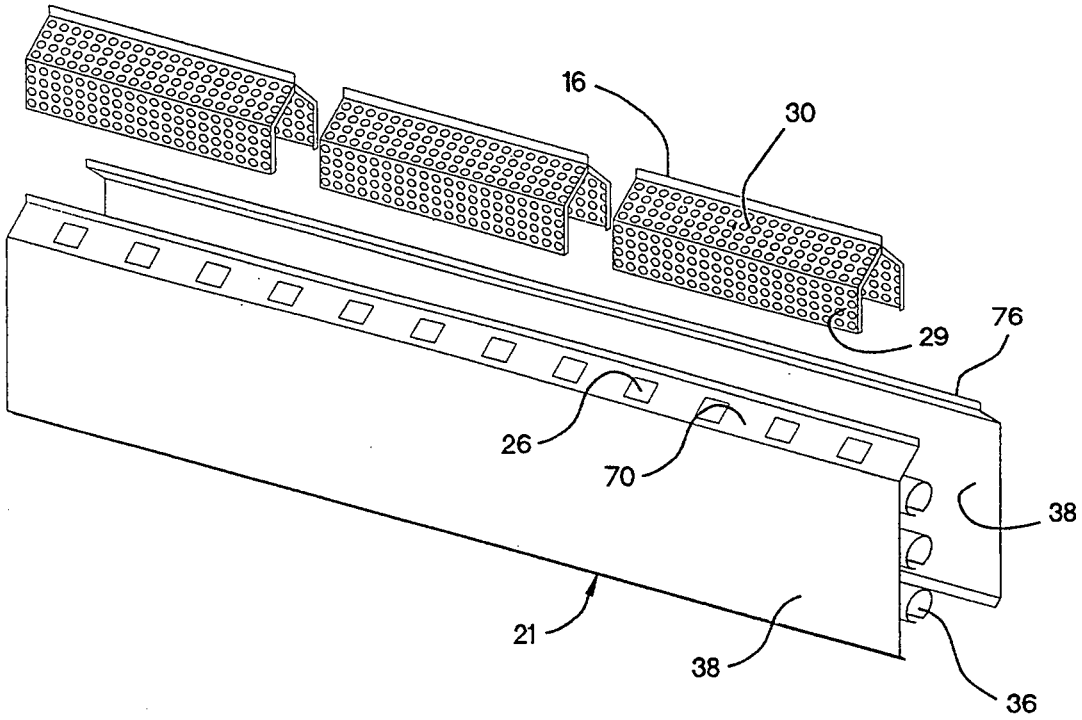
FIG. 9 is an exploded perspective illustration of preferred air discharge chamber of this invention.

FIG. 9 illustrates features of the construction of a preferred exhaust assembly 21. The exhaust assembly contains substantially parallel side panels 38 having apertures 26 on the upper angular section 70 attached to each side panel 38 having flange 76 adjacent each upper angular section 70 for joining side panels 38. The apertures are sized and spaced to provide even distribution of air in the dryer. Accordingly, the number and size of each aperture may be varied for the particular material to be dried. As previously noted, the size of apertures 26 may also be variable, but preferably the apertures 26 are of fixed size. The exhaust assembly also contains a plurality of exhaust tubular members 36 disposed within the side panels 38 of the exhaust assembly. Covering the apertures 26 are preferably sectional foraminous members 16 containing angular section 30 and vertical section 29. The openings in the foraminous member 16 are sized to limit the amount of particulate material exiting the exhaust assembly. Any type of perforated or mesh material may be used as the foraminous member 16. Such perforated or mesh materials may be coated or uncoated. The selection of suitable foraminous materials is related to the material to be dried and is well within the skill of those in the art.

In the lower portion of the dryer is the cooling zone 19 (FIG. 2). This zone contains a cooling air discharge unit 24 for supply of cooling air. Below the cooling air discharge unit 24 is a metering floor 72 containing a plurality of metering tubes 74 for delivery of dried material to metering rolls 20 which deliver the dried material to hopper 8 below the cooling zone 19. The metering rolls 20 may be augers arranged in parallel rows and interconnected such that they operate at a uniform speed so that the particulate material moving by gravity down through the dryer moves essentially evenly through the entire cross-section of the dryer. Dried material is collected in the bottom of the dry material hopper 8 and discharged by means of discharge conveyer 22 to storage vessels or silos. Particularly preferred metering tubes and metering rolls are disclosed in U.S. Pat. No. 4,152,841 to Westelaken, incorporated herein by reference as if fully set forth.

In another particularly preferred embodiment, this invention provides a method for the uniform drying of particulate material. The method comprises feeding particulate material to be dried to a concurrent-countercurrent flow dryer 10 comprising a tower with side walls 12, a top 13, a bottom 14, an upper section, a middle section and a lower section. The tower has a receiving bin 4 located in the upper section for receiving particulate material to be dried. The receiving bin 4 preferably contains a drying floor assembly 15 extending across between the side walls 12 of the tower, the floor assembly having a plurality of essentially uniformly spaced openings extending over substantially the entire floor assembly. The openings in the floor assembly 15 provide entry into particulate material delivery tube members 39 fixed beneath each of the openings and serving to deliver particulate material in response to gravity from the receiving bin 4 through the tube members 39 into a drying zone 6 located in the middle section of the dryer below the receiving bin. The particulate material is dried in the drying zone 6 with heated air as the material moves by gravity through the dryer. The particulate material is cooled with cooling air entering from a cooling zone 19 located below the drying zone 6. The cooling zone 19 contains a cooling air inlet in the form of a cooling air distribution unit 24 for countercurrent flow of cooling air. Below the cooling zone 19 is a dry material outlet for collection and discharge of dry material.

In order to effectively dry a particulate material, the drying zone 6 contains a heated air inlet 23 for delivering heated air into the spaces between the tube members 39 and downwardly through a bed of particulate material in the drying zone. A plurality of air exhaust assemblies 21 intermediate the drying and cooling zones extend horizontally across the tower between the side walls 12 for receiving and exhausting air from the drying zone 6 through the bed of material to be dried in a concurrent direction to material flow. The exhaust assemblies 21 also receive and exhaust cooling air from the cooling zone through the bed of material in a countercurrent direction to material flow. The exhaust assemblies have adjustable apertures for adjusting the air flow exiting the dryer. In particular each air exhaust assembly 21 contains a discharge chamber having at least one aperture 26 in the upper portion thereof for receiving air. The aperture 26 is covered by foraminous member 16 sized to substantially limit the amount of material entering the aperture 26 of the discharge chamber. Each discharge chamber also contains at least one horizontally disposed exhaust tubular member 36 (FIG. 3) having an aperture 52, preferably in the lower portion of the tubular member for exhausting air. The apertures 52 in the exhaust tubular member 36 are preferably adjustable.

Having described the invention in its preferred embodiments, it will be recognized that variations of the invention by those skilled in the art are within the spirit and scope of the appended claims.

What I claim is:

1. A concurrent-countercurrent flow dryer for uniform drying of moisture laden solid material comprising a tower with side walls; a top; a bottom; an upper section having a receiving bin for receiving moisture laden solid material to be dried; a middle section having at least one drying zone; a lower section having a cooling zone below said drying zone for cooling said material as it enters by gravity from said drying zone, said receiving bin having a drying floor assembly extending horizontally across between the side walls of the tower, said floor assembly containing a plurality of essentially uniformly spaced openings extending over substantially the entire floor assembly, said openings providing entry into moisture laden material delivery tube members fixed beneath each said opening and serving to deliver moisture laden solid material in response to gravity from said receiving bin through said tube members into said drying zone, said drying zone having a heated air inlet adjacent said tube members adapted to deliver heated air into the spaces between said tube members and downwardly through a bed of moisture laden solid material in said drying zone and said cooling zone containing a cooling air inlet and a dry material outlet for collection and discharge of dry solid material; and a plurality of exhaust assemblies for flow of solid material therebetween, intermediate said drying and cooling zones extending horizontally across said tower between the side walls for receiving and exhausting air from said drying zone through said bed of solid material to be dried in a concurrent direction to solid material flow and for receiving and exhausting cooling air from said cooling zone through said bed of solid material in a countercurrent direction to solid material flow, wherein each air exhaust assembly contains a discharge chamber having upper and lower portions and having substantially parallel side walls, said discharge chamber containing at least one horizontally disposed exhaust tubular member between the side walls of the discharge chamber for exhausting air, said tubular member having an aperture in the lower portion thereof and said discharge chamber having at least one aperture in the upper portion thereof for receiving air, said upper aperture in said discharge chamber being covered by a foraminous member sized-to substantially limit the amount of particulate material entering the aperture of said discharge chamber.

2. The concurrent-countercurrent flow dryer of claim 1 further comprising a drying air supply means and a cooling air supply means.

3. The concurrent-countercurrent flow dryer of claim 1 wherein said discharge chamber further comprises an aperture in the lower portion thereof for discharge of particulate material passing through said foraminous member or entrained in said heating or cooling air.

4. The concurrent-countercurrent flow dryer of claim 1 wherein the aperture in the lower portion of said exhaust tubular is an adjustable aperture.

5. The concurrent-countercurrent flow dryer of claim 1 wherein said exhaust tubular member is comprised of in inner and an outer tubular member, rotatably disposed relative to one another, each of said inner and outer tubular members containing an aperture of a fixed size whereby rotation of said tubular members adjusts the size of said aperture through said exhaust tubular members.

6. The concurrent-countercurrent flow dryer of claim 1 further comprising at least about three exhaust tubular members in each of said discharge chamber.

7. The concurrent-countercurrent flow dryer of claim 1 further comprising a tempering zone below said drying zone, a second drying zone below said tempering zone and a plurality of second exhaust assemblies below said second drying zone.

8. The concurrent-countercurrent flow dryer of claim 1 further comprising a plurality of tempering zones below said receiving bin, each tempering zone having associated therewith a second drying zone below each said tempering zone and a plurality of second exhaust assemblies below each said second drying zone.

9. The concurrent-countercurrent flow dryer of claim 5 wherein the apertures in said exhaust tubular members are rectangular in shape.

10. The concurrent-countercurrent flow dryer of claim 5 wherein the apertures in said exhaust tubular members are diamond-shaped.

11. The concurrent-countercurrent flow dryer of claim 5 wherein one of said exhaust tubular members has a diamond-shaped aperture and the other of said exhaust tubular members has a rectangular-shaped aperture such that rotation of said tubular exhaust members relative to one another provides a variable cross-sectional opening in said tubular members.

12. A dryer for uniform drying of moisture laden particulate material comprising a substantially vertical tower having a top; a bottom; side walls; a moist material inlet; a moist material distribution section below said inlet; a drying zone below said distribution section, said drying zone containing a heated air inlet; a cooling zone below said drying zone, said cooling zone containing a cooling air inlet; and a plurality of air exhaust assemblies, wherein each of said air exhaust assembly contains a discharge chamber having an upper and a lower portion and having substantially parallel side walls, said discharge chamber extending horizontally across the tower between the side walls for flow of particulate material therebetween, said discharge chamber containing at least one horizontally disposed exhaust tubular member between the side walls of the discharge chamber for exhausting air, said tubular member having an aperture in a lower portion thereof and said discharge chamber having at least one aperture in the upper portion thereof for receiving air, said upper aperture in said discharge chamber being covered by a foraminous member sized to substantially limit the amount of particulate material entering the aperture of said discharge chamber.

13. The dryer of claim 12 wherein said discharge chamber further comprises an aperture in the lower portion thereof for discharge of particulate material passing through said foraminous member.

14. The dryer of claim 12 wherein the aperture in the lower portion of said exhaust tubular is an adjustable aperture.

15. The dryer of claim 12 wherein said exhaust tubular member is comprised of an inner and an outer tubular member, rotatably disposed relative to one another, each of said inner and outer tubular members containing an aperture of a fixed size whereby rotation of said tubular members relative to one another adjusts the size of said aperture through said exhaust tubular members.

16. The dryer of claim 12 further comprising at least about three exhaust tubular members in each of said discharge chamber.

17. The dryer of claim 15 wherein the apertures in said exhaust tubular members are rectangular in shape.

18. The dryer of claim 15 wherein the apertures in said exhaust tubular members are diamond-shaped.

19. The dryer of claim 15 wherein one of said exhaust tubular members has a diamond-shaped aperture and the other of said exhaust tubular members has a rectangular-shaped aperture such that rotation of said tubular exhaust members relative to one another provides a variable cross-sectional opening in said tubular members.

20. A method for the uniform drying of particulate material comprising feeding particulate material to be dried to a concurrent-countercurrent flow dryer comprising a tower with side walls, a top, a bottom, an upper section, a middle section and a lower section, said tower having a receiving bin in the upper section for receiving particulate material to be dried and serving to deliver particulate material into a drying zone located in the middle section of the dryer below the receiving bin;

drying said particulate material in said drying zone with heated air, wherein said drying zone contains a heated air inlet for delivering heated air into said drying zone;

cooling said particulate material with cooling air in a cooling zone located below said drying zone, said cooling zone containing a cooling air inlet and a dry material outlet for collection and discharge of dry material; and exhausting air from said drying and cooling zones through one or more exhaust assemblies located intermediate said drying and cooling zones, each exhaust assembly extending horizontally across said tower between the side walls for receiving and exhausting air from said drying zone through said bed of material to be dried in a concurrent direction to material flow and for receiving and exhausting cooling air from said cooling zone through said bed of material in a countercurrent direction to material flow, wherein each said air exhaust assembly contains a discharge chamber, each of said discharge chamber having-substantially parallel side walls and having at least one aperture in the upper portion thereof for receiving air, said aperture being covered by a foraminous member sized to substantially limit the amount of material entering the aperture of said discharge chamber and said discharge chamber containing at least one horizontally disposed exhaust tubular member between the side walls of the discharge chamber said tubular member having an aperture in a lower portion thereof for exhausting air entering said discharge chamber.

21. The method of claim 20 wherein said discharge chamber further comprises an aperture in the lower portion thereof for discharge of particulate material passing through said foraminous member or entrained in said heating or cooling air.

22. The method of claim 20 wherein the aperture in the exhaust tubular member is an adjustable aperture and further comprising adjusting the aperture in said exhaust tubular member to vary the amount of air exhausting from the drying and cooling zone.

23. The method of claim 20 wherein said exhaust tubular member is comprised of in inner and an outer tubular member, rotatably disposed relative to one another, each of said inner and outer tubular members containing an aperture of a fixed size whereby rotation of said tubular members relative to one another adjusts the size of said aperture through said exhaust tubular members.

24. The method of claim 20 further comprising at least about three exhaust tubular members in each of said discharge chamber.

25. The method of claim 20 further comprising a tempering zone below said drying zone, and a second drying zone below said tempering zone and one or more second exhaust assemblies below said second drying zone.

26. The method of claim 20 further comprising a plurality of tempering zones below said receiving bin, each tempering zone having associated therewith a second drying zone below each said tempering zone and a plurality of second exhaust assemblies below each said second drying zone.

27. The method of claim 23 wherein the apertures in said exhaust tubular members are rectangular in shape.

28. The method of claim 23 wherein the apertures in said exhaust tubular members are diamond-shaped.

29. The method of claim 23 wherein one of said exhaust tubular member has a diamond-shaped aperture and the other of said exhaust tubular member has a rectangular-shaped aperture such that rotation of said tubular exhaust members relative to one another provides a variable cross-sectional opening in said tubular members.

30. An exhaust assembly for a particulate dryer comprising an air exhaust discharge chamber having substantially parallel side walls and having an upper portion, a lower portion and at least one exhaust tubular member disposed within said chamber between .said upper and lower portions and between the side walls of the discharge chamber, said upper portion containing one or more apertures for receiving air into said chamber, said one or more apertures being covered by a foraminous member sized to substantially limit the amount of particulate material entering the aperture of said discharge chamber, and each of said tubular members containing an aperture in a lower portion thereof for receiving and exhausting air entering said chamber.

31. The exhaust assembly of claim 30 wherein said discharge chamber further comprises an aperture in the lower portion thereof for discharge of particulate material passing through said foraminous member or entrained in said air.

32. The exhaust assembly of claim 30 wherein the aperture in the lower portion of said exhaust tubular is an adjustable aperture.

33. The exhaust assembly of claim 30 wherein said exhaust tubular member is comprised of in inner and an outer tubular member, rotatably disposed relative to one another, each of said inner and outer tubular members containing an aperture of a fixed size whereby rotation of said tubular members relative to one another adjusts the size of said aperture through said exhaust tubular members.

34. The exhaust assembly of claim 30 further comprising at least about three exhaust tubular members disposed within said discharge chamber.

35. A method for the uniform drying of particulate material comprising feeding particulate material to be dried to a concurrent-countercurrent flow dryer comprising a tower with side walls, a top, a bottom, an upper section, a middle section and a lower section, said tower having a receiving bin in the upper section for receiving particulate material to be dried and serving to deliver particulate material into a drying zone located in the middle section of the dryer below the receiving bin;

drying said particulate material in said drying zone with heated air, wherein said drying zone contains a heated air inlet for delivering heated air into said drying zone;

cooling said particulate material with cooling air in a cooling zone located below said drying zone, said cooling zone containing a cooling air inlet and a dry material outlet for collection and discharge of dry material; and controlling an amount of air exhausted from said drying and cooling zones through one or more exhaust assemblies having adjustable apertures by adjusting said apertures to control the amount air exiting said dryer, said exhaust assemblies located intermediate said drying and cooling zones, each exhaust assembly extending horizontally across said tower between the side walls for receiving and exhausting air from said drying zone through said bed of material to be dried in a concurrent direction to material flow and for receiving and exhausting cooling air from said cooling zone through said bed of material in a countercurrent direction to material flow.

36. The method of claim 35 further comprising a tempering zone below said drying zone, and a second drying zone below said tempering zone and one or more second exhaust assemblies below said second drying zone.

37. The method of claim 35 further comprising a plurality of tempering zones below said receiving bin, each tempering zone having associated therewith a second drying zone below each said tempering zone and a plurality of second exhaust assemblies below each said second drying zone.

* * * * *